US007775474B2

(12) United States Patent
Maruyama

(10) Patent No.: US 7,775,474 B2
(45) Date of Patent: Aug. 17, 2010

(54) WIRE WINDING APPARATUS

(75) Inventor: Akihiro Maruyama, Hanno (JP)

(73) Assignee: Taga Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 12/225,486

(22) PCT Filed: Mar. 28, 2007

(86) PCT No.: PCT/JP2007/056672

§ 371 (c)(1),
(2), (4) Date: Sep. 23, 2008

(87) PCT Pub. No.: WO2007/114171

PCT Pub. Date: Oct. 11, 2007

(65) Prior Publication Data

US 2009/0108118 A1 Apr. 30, 2009

(30) Foreign Application Priority Data

Mar. 31, 2006 (JP) ..... 2006-099033

(51) Int. Cl.
*B65H 81/02* (2006.01)

(52) U.S. Cl. ..... 242/434.9; 242/439.1; 242/448; 242/433.1

(58) Field of Classification Search ..... 242/434.9, 242/437, 439.1, 439.2, 439.4, 443.1, 448, 242/433.1

See application file for complete search history.

(56) References Cited

U.S. PATENT DOCUMENTS 4,809,917 A * 3/1989 Tsuchiya ..... 242/439.5
4,817,888 A * 4/1989 Arnold ..... 242/437.2
4,966,337 A * 10/1990 Fahrbach ..... 242/437.2
5,397,070 A * 3/1995 Yano ..... 242/443.1
5,538,196 A * 7/1996 Auchincloss et al. ..... 242/445.1
6,679,449 B2 * 1/2004 Sugiuchi ..... 242/439.1

FOREIGN PATENT DOCUMENTS

JP 3-250611 11/1991
JP 4-151811 5/1992
JP 6-302453 10/1994

OTHER PUBLICATIONS

International Search Report issued Jul. 10, 2007 in the International (PCT) Application of which the present application is the U.S. National Stage.

* cited by examiner

*Primary Examiner*—Emmanuel M Marcelo
(74) *Attorney, Agent, or Firm*—Wenderoth, Lind & Ponack, L.L.P.

(57) ABSTRACT

A wire winding apparatus can reduce the burden of momentum on the side of the nozzle cooperated with the spindle shaft in winding operation, thereby enabling an effective winding operation. The winding apparatus comprises a carrier carrying at least one bobbin to be wound with wire, a nozzle for supplying the wire to be wound around the bobbin, a spindle shaft for rotating the bobbin, a working table disposed opposite to the nozzle and spindle shaft so as to introduce the carrier into between the nozzle and spindle shaft, wherein the spindle shaft is retractable relative to the bobbin carried on the carrier fed onto the working table so as to allow the bobbin to move between the carrier and nozzle.

20 Claims, 10 Drawing Sheets

WIRE WINDING APPARATUS

TECHNICAL FIELD

This invention relates to the technical field of a wire winding apparatus for winding wires on bobbins continuously supplied in a state mounted on a carrier.

BACKGROUND OF THE INVENTION

A recent automatic wire-winding system using bobbins continuously supplied to a wire winding apparatus is provided with a carrying device for carrying the bobbins while being carried on a carrier (palette). Thus, this system requires means for effectively transferring the bobbin or carrier between the carrying device and the winding apparatus.

The following technique is one known example for transferring the bobbin or carrier.

[Patent Literature 1] Japanese Published Unexamined Application HEI 06-302453(A)

Patent Literature 1 discloses a wire winding system in which a winding bobbin carried on a bobbin carrier when being carried by a carrying device is introduced along with the bobbin carrier from the carrying device into a winding apparatus so as to prevent the carrier emptied during winding operation from staying in the carrying device.

A plurality of wire winding apparatuses are installed along the carrying device in the winding system disclosed in Patent Literature 1, so that each winding apparatus can perform winding operations while the carrier carrying the bobbin is transported to the other winding apparatus in order for saving waiting time in which the other winding apparatus stands by until winding operation in the winding apparatus working in the system is finished. This winding system has a spindle shaft connected to the bobbin sent to the winding apparatus to rotate the bobbin and a retractable nozzle for feeding wire to be wound on the bobbin.

DISCLOSURE OF INVENTION

Problems to be Solved by the Invention

The conventional wire winding system disclosed in Patent Literature 1 has a problem that the cooperative nozzle and spindle shaft bear a substantial burden of momentum on the side of the nozzle connected to complicated mechanism such as a dimension moving mechanism, consequently to preclude an effective winding operation in the winding apparatus.

In light of this disadvantage of the conventional winding system as described above, it is an object of the present invention to provide a wire winding apparatus having a nozzle and a spindle shaft cooperated in winding wire so as to reduce the burden of momentum on the side of the nozzle, thereby enabling an effective winding operation.

Means for Solving the Problems

The winding apparatus according to the invention made for solving the foregoing problems is set forth in the claims and described in the specification.

To be specific, according to the invention, there is provided a winding apparatus using a carrier carrying at least one bobbin to be wound with wire, comprising a nozzle for supplying the wire to be wound around the bobbin, a spindle shaft for rotating the bobbin, a working table disposed opposite to the nozzle and spindle shaft so as to introduce the carrier into between the nozzle and spindle shaft, wherein the spindle shaft is retractable relative to the bobbin carried on the carrier fed onto the working table so as to allow the bobbin to move between the carrier and nozzle.

According to the winding apparatus, since the spindle shaft is moved back and forth toward the bobbin carried by the carrier fed to the working table placed between the opposed nozzle and spindle shaft so as to allow the bobbin to move between the carrier and nozzle, a part of momentum on the side of the nozzle can be shifted to the side of the spindle shaft.

The winding apparatus of the invention is further featured in that the bobbin is detachably supported by a support member so as to have its axis directed to the direction in which the nozzle and spindle shaft are opposite to each other, and the carrier is provided with an insertion holes for allowing the spindle shaft to pass therethrough relative to the bobbin supported by the support member.

According to this structure as described above, the spindle shaft causes the bobbin to pass through the insertion hole in the carrier and support member and move between the carrier and nozzle.

The winding apparatus of the invention is further featured in that the support member of the carrier is formed in a cylindrical shape having a prescribed cross section so as to detachably attach the bobbin thereinto in the axial direction.

According to this invention, the bobbin can be attached and detached relative to the support member of the carrier with such a simple structure.

The winding apparatus of the invention is further featured in that the carrier is provided with one support member.

In this winding apparatus according to the invention, one carrier is used exclusively for feeding one bobbin.

The winding apparatus of the invention is further featured in that carrier is provided with a plurality of support members.

In this winding apparatus according to the invention, one carrier is used for feeding the plurality of bobbins.

The winding apparatus of the invention is further featured in that the bobbin is formed in a hollow shape so as to allow the leading end of the spindle shaft to be fitted thereinto, and the spindle shaft is provided with a chuck mechanism for internally holding the bobbin fitted to the spindle shaft.

According to this structure, the bobbin can be positively held by the chuck mechanism disposed at the leading end of the spindle shaft.

The winding apparatus of the invention is further featured in that the bobbin is formed in a non-hollow shape so as not to allow the leading end of the spindle shaft to be fitted thereinto, but has an auxiliary jig so as to be engaged with the leading end of the spindle shaft, and the spindle shaft is provided with a chuck mechanism for internally holding the auxiliary jig engaged with the spindle shaft.

According to this structure, the bobbin can be positively held by the chuck mechanism disposed at the leading end of the spindle shaft through the auxiliary jig.

EFFECT OF THE INVENTION

Since the winding apparatus of the invention is constructed so as to move the spindle shaft back and forth toward the bobbin carried by the carrier fed to the working table placed between the opposed nozzle and spindle shaft, thus to allow the bobbin to move between the carrier and nozzle, a part of momentum on the side of the nozzle can be shifted to the side of the spindle shaft so as to reduce the burden of momentum on the side of the nozzle cooperated with the spindle shaft in winding operation, thereby enabling an effective winding operation.

EXPLANATION OF REFERENCE MARKS

3 Winding apparatus
3*a* Working table
3*b* Main frame of winding apparatus
3*ba* Nozzle
3*c* Spindle
3*ca* Spindle shaft
B Bobbin
C Carrier
Cb Support member
Cc Insertion hole
W Wire

DETAILED DESCRIPTION OF THE INVENTION

Figure 1:
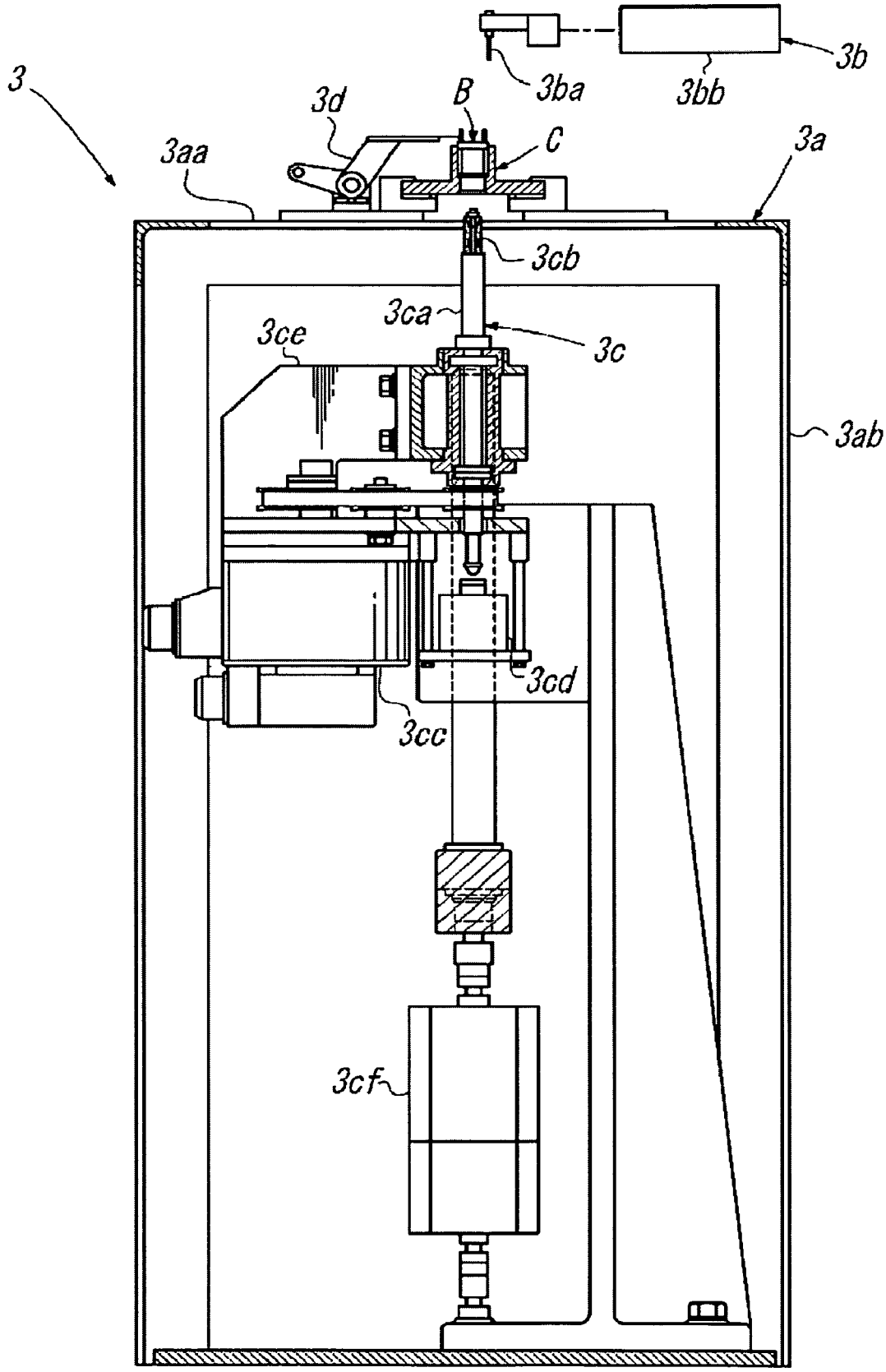
FIG. 1 is a cross section of one embodiment of a winding apparatus according to the invention.
Figure 2:
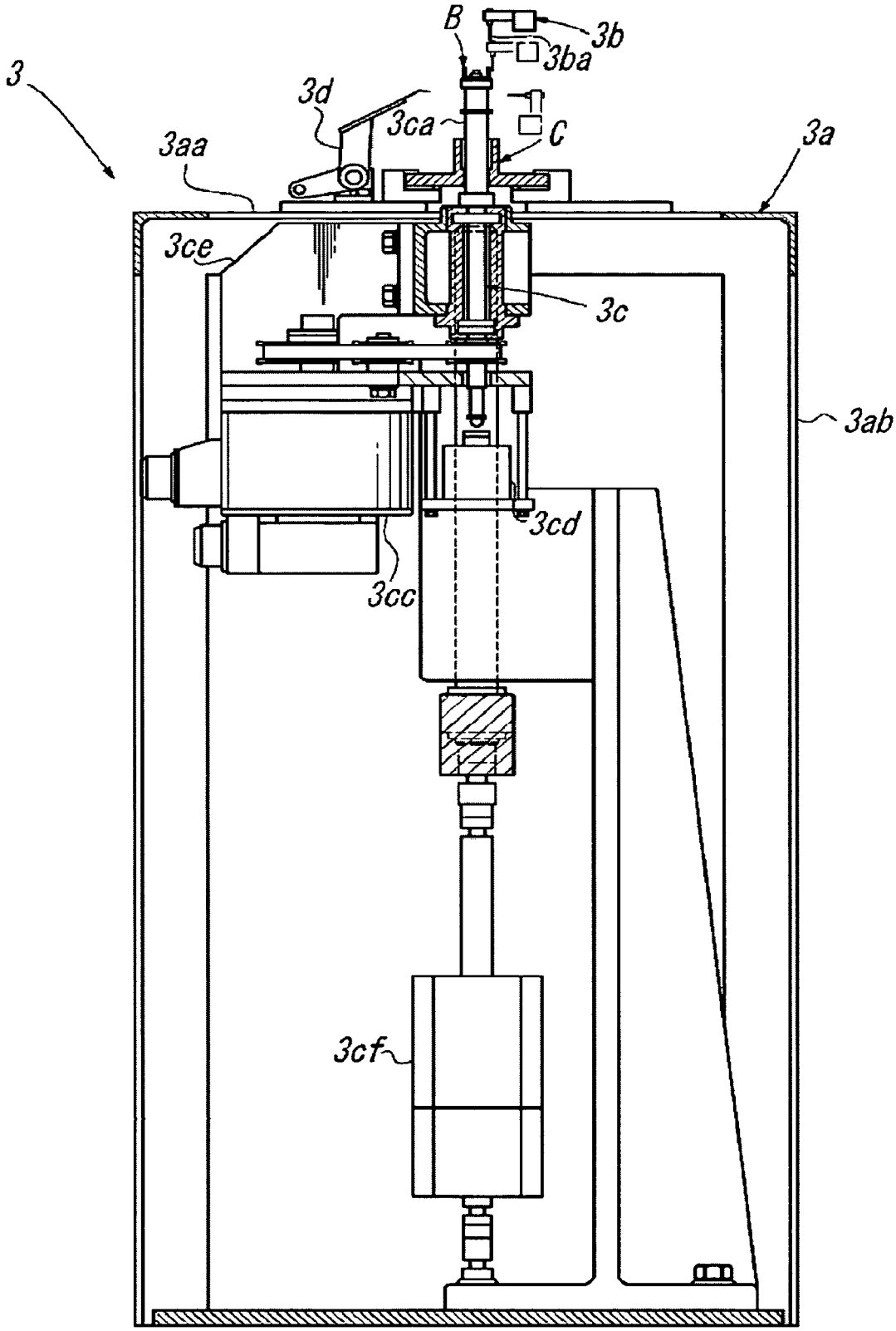
FIG. 2 is a sequence diagram showing the operation of FIG. 1.
Figure 3:
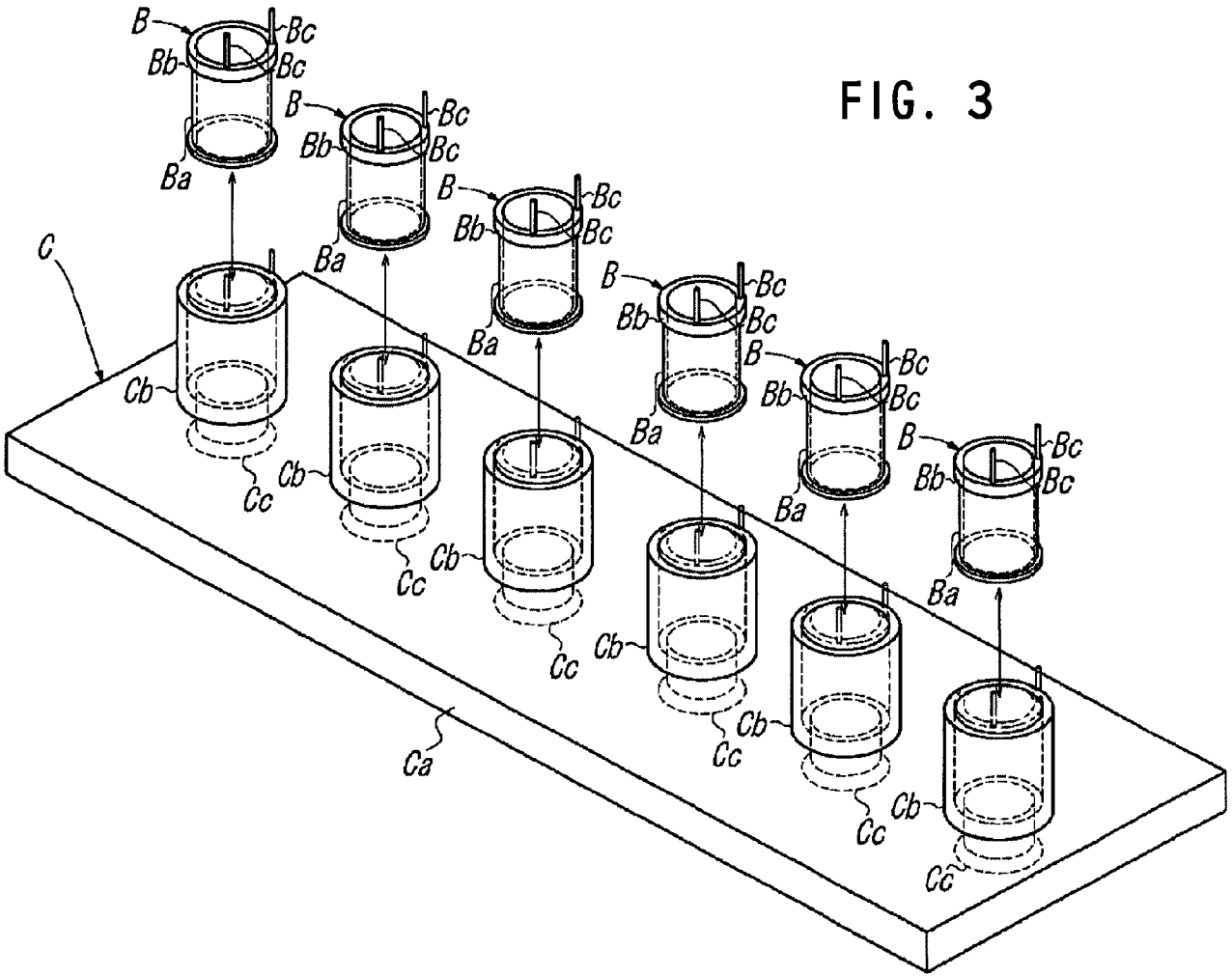
FIG. 3 is an enlarged perspective view showing the principal part of FIG. 1.

An exemplary embodiment of the invention will be described hereinafter with reference to the accompanying drawings. FIG. 1 is a cross section of the one embodiment of the wire winding apparatus according to the invention. FIG. 2 is a sequence diagram showing the operation of FIG. 1. FIG. 3 is an enlarged perspective view showing the principal part of FIG. 1.

The embodiment using a carrier C carrying six hollow bobbins B with vertical axes is shown in FIG. 3.

Figure 5:
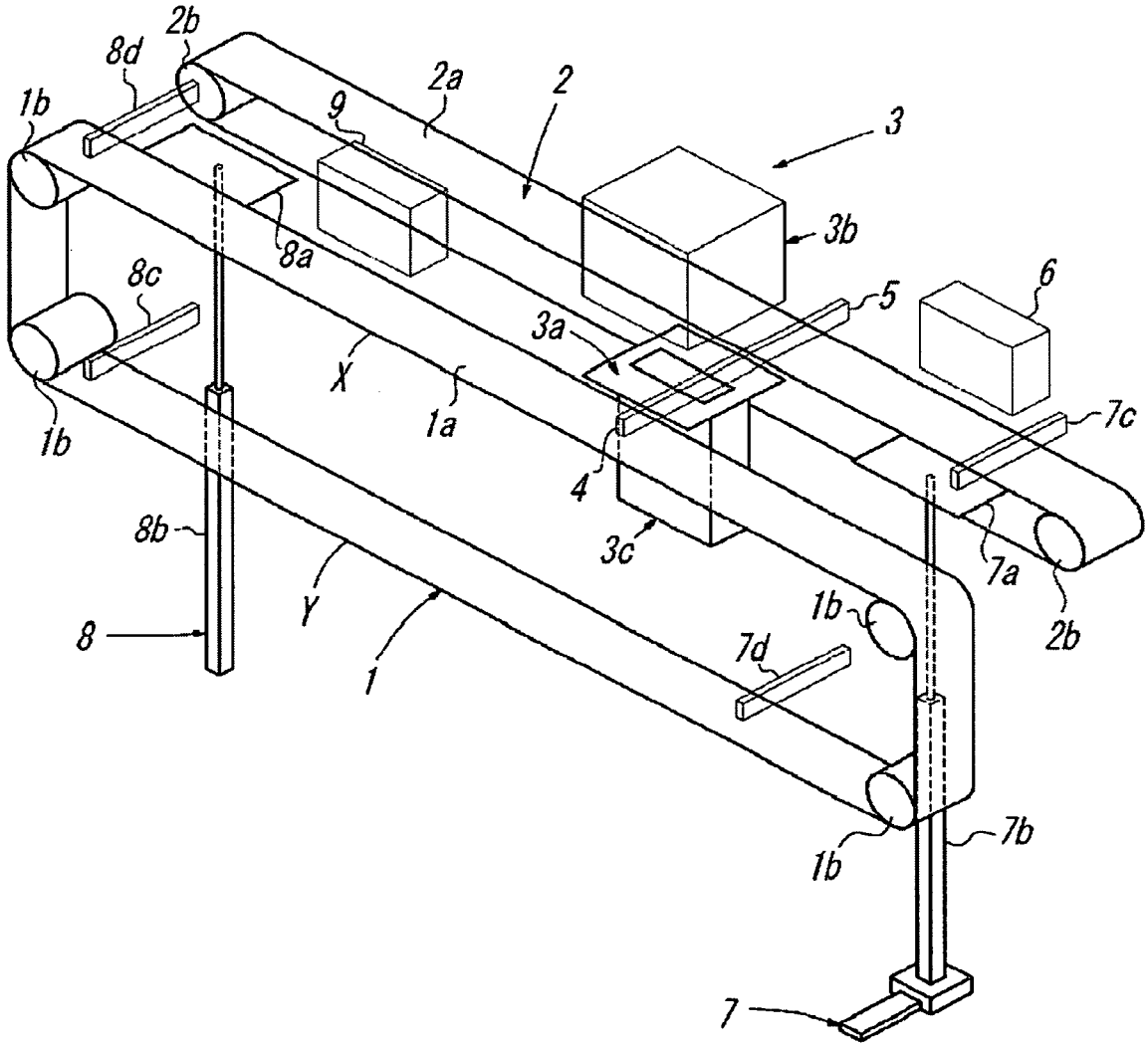
FIG. 5 is a perspective view showing one embodiment of a wire winding system provided with the winding apparatus of the invention.
Figure 6:
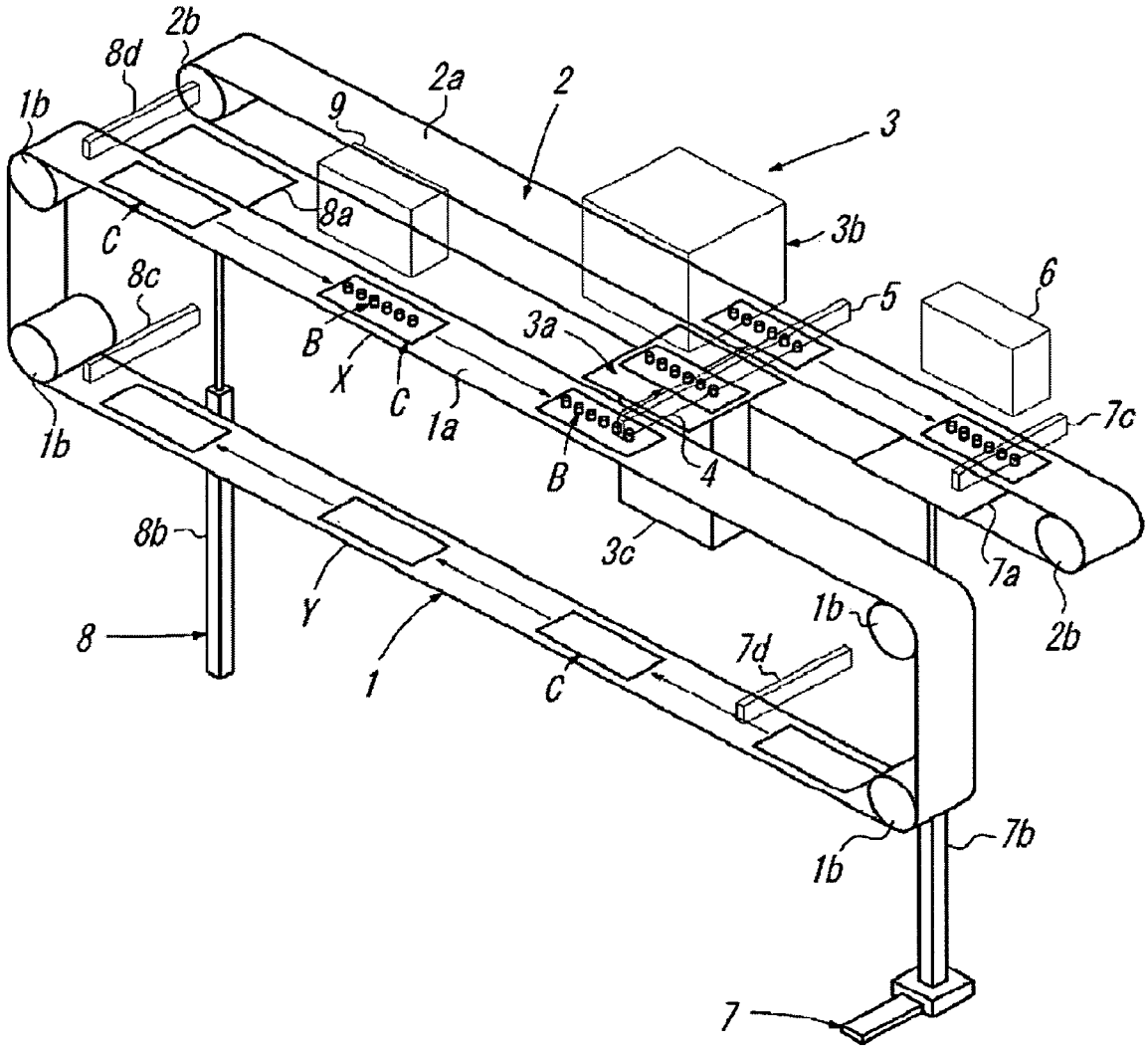
FIG. 6 is a sequence diagram showing a sequence of operation for feeding and recovering bobbins in the system of FIG. 5.
Figure 7A:
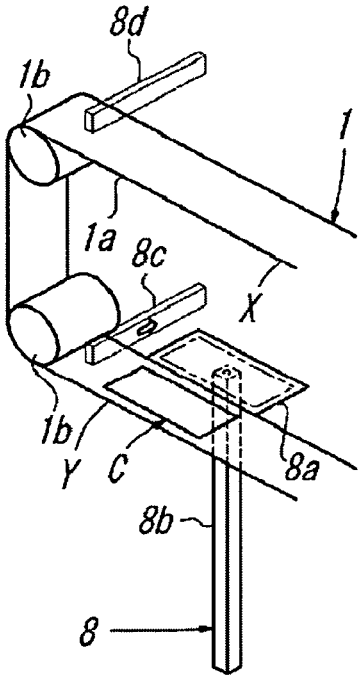
FIGS. 7(A) through 7(C) show the operation of the principal part of FIG. 5 in sequence of the operation.
Figure 7B:
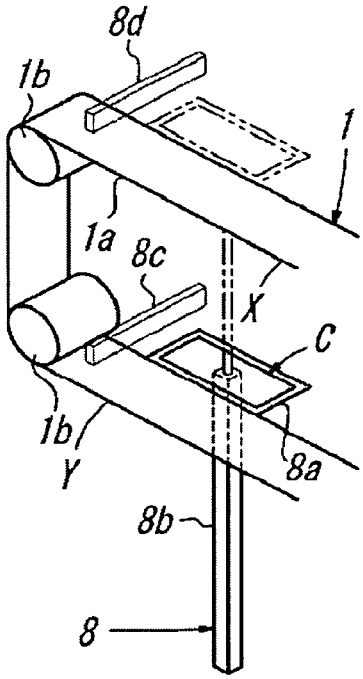
Figure 7C:
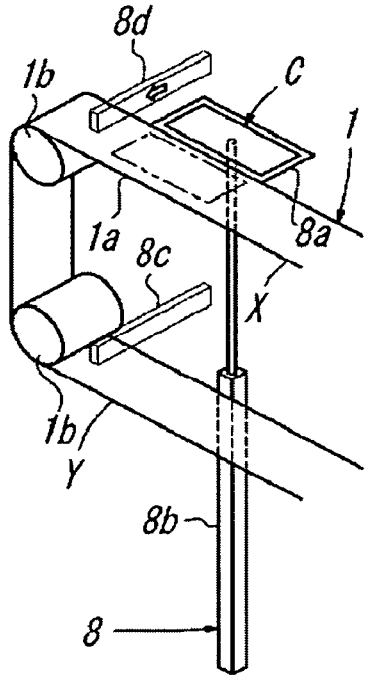

This embodiment forms a wire winding system having a wire winding apparatus 3 between a feed carrying device 1 and a retrieval carrying device 2, which are arranged in parallel, as shown in FIG. 5 and FIG. 6.

The feed carrying device 1 serves to convey (feed) the carrier C carrying the bobbins B to the winding apparatus 3. The feed carrying device 1 is formed by having a belt-like conveyor belt 1*a* held by a plurality of rollers 1*b* in an endless form and distances spreading upward and downward so as to form a two-stage circulation type structure of a forward path X and a return path Y. In the forward path X placed upside, the upper side of the conveyor belt 1*a* is used as a conveyor surface for the carrier C carrying the bobbins B. The lower return path Y is defined on the under side to which the upper side of the conveyor belt 1*a* in the forward path X is placed facedown in the return path Y. At least one of the rollers 1*b* is connected as a driving roller to a not-shown motor acting at a driving source so as to rotate intermittently.

The retrieval carrying device 2 serves to cause the carrier C carrying the bobbins B around which wires are wound by the winding apparatus 3 to be conveyed (fed) out of the winding apparatus 3. The retrieval carrying device 2 is formed by having a belt-like conveyor belt 2*a* held by a plurality of rollers 2*b* in an endless form and distances narrowing upward and downward so as not to form the forward path X and the return path Y in the feed carrying device 1. Thus, the conveyor surface along which the carrier C carrying the bobbins wound with wires is transferred and the upper side of the conveyor belt 2*a* are used. At least one of the rollers 2*b* is connected as a driving roller to a not-shown motor (which may be the same motor in the feed carrying device 1 or different therefrom) acting at a driving source so as to rotate intermittently.

The forward path X of the feed carrying device 1 and the retrieval carrying device have the same common conveyor surface.

The wire winding device 3 serves to wind the wire W on the bobbin B as shown minutely in FIG. 1 and FIG. 2. The winding device 3 is placed in an area reserved substantially in the middle relative to the feedforward direction between the feed carrying device 1 and retrieval carrying device 2 and provided with a working table 3*a*, a main frame 3*b*, a spindle 3*c* and a bobbin retainer 3*d*. The working table 3*a* is provided with a support face 3*aa* formed in the shape of a window frame partly having an opening in the same surface on which the carrier C is placed carrying the bobbins B as the conveyor surface of the forward path X of feed carrying device 1 and the conveyor surface of the retrieval carrying device 2, and a box 3*ab* for holding the spindle 3*c* thereinside. The main frame 3*b* of the winding apparatus is placed above the working table 3*a* and provided with a nozzle 3*ba* from which the wire W to be wound on the bobbin B is fed out and a three-dimension moving mechanism 3*bb* connected to the nozzle 3*ba* for moving the nozzle 3*ba* in the three dimensional direction. The spindle 3*c* is placed below the working table 3*a* and provided with a spindle shaft 3*ca* for rotating the bobbin B, a chuck mechanism 3*cb* disposed at the leading end of the spindle shaft 3*ca* and inserted into the hollow bobbin B to retain the bobbin thereinside, a spindle motor 3*cc* for rotating the spindle shaft 3*ca*, a chuck cylinder 3*cd* for driving the chuck mechanism 3*cb*, a lifting frame 3*ce* for supporting the chuck cylinder 3*cd*, and a driving cylinder cf held by the box 3*ab* of the working table 3*a* to move the lifting frame 3*ce* up and down. The bobbin retainer 3*d* is mounted on the support face 3*aa* of the working table 3*a* and has an arm lightly depressing the bobbin B on the carrier C.

Between the feed carrying device 1 and the support face 3*aa* of the working table 3*a*, a supply/transfer mechanism 4 is provided. By the supply/transfer mechanism 4, the carrier C carrying the bobbins B is sent from the feed carrying device 1 to the working table 3*a* in the winding apparatus 3 by using appropriate sliding and lifting means.

Between the support face 3*aa* of the working table 3*a* of the winding apparatus and the retrieval carrying device 2, a retrieval moving device 5 is placed. The retrieval moving device 5 serves to retrieve the carrier C carrying the bobbins B wound with wire in the winding apparatus 3 from the working table 3*a* of the winding apparatus 3 into the retrieval carrying device 2 by using appropriate sliding and lifting means.

The supply/transfer mechanism 4 and the retrieval moving device 5 may be operated in an integrated and consistent manner by making use of a common mechanism or synchronously by using individual mechanisms so as to make fine adjustments in operation timing and operating speed.

In the vicinity of the terminal end of the retrieval carrying device 2, a bobbin retrieving device 6 is placed. The bobbin retrieving device is provided with a lifting handle and others so as to retrieve the bobbins B wound with the wire from the carrier C.

Between the terminal end (more to the side of the terminal end than the bobbin retrieving device 6) of the retrieval carrying device 2 and the terminal end of the return path Y of the feed carrying device 1, a transferring device 7 is placed. The transferring device 7 has a drive means 7*b* comprising a driving cylinder or the like for slidably moving a lifting slider 7*a* for carrying the empty carrier C in the vertical direction, an upper transfer means 7*c* comprising a driving cylinder or the like for transferring the empty carrier C from the retrieval carrying device 2 to the lifting slider 7*a*, and a lower transfer means 7*d* for transferring the empty carrier C from the lifting slider 7*a* to the feed carrying device 1. By the transferring device 7, the empty carrier C from which the bobbin B wound with the wire is retrieved is transferred from the terminal end of the retrieval carrying device 2 to the return path Y of the feed carrying device 1.

Between the terminal end of the return path Y and the starting end of the forward path X of the feed carrying device 1, a refeeding mechanism 8 is placed. The refeeding mechanism 8 has a drive means 8*b* comprising a driving cylinder or the like for vertically moving a lifting board 8*a* carrying the empty carrier C, a lower transfer means 8*c* comprising a driving cylinder or the like for transferring the empty carrier C from the return path Y of the feed carrying device 1 to the lifting board 8*a*, and an upper transfer means 8*d* for transferring the empty carrier C from the lifting board 8*a* to the forward path X of the feed carrying device 1. By the refeeding mechanism 8, the empty carrier C from which the bobbin B wound with the wire is retrieved is fed again from the forward path X of the feed carrying device 1.

The carrier C has fix support projections Cb arranged in line along the longitudinal center of the upper surface of the rectangle basal plate Ca and through holes Cc opening into the support projections Cb. The support projection Cb is formed in a cylindrical shape in the illustrated embodiment, but not limited to this shape. For instance, the support projection may have a rectangular cross section. The through hole Cc has a diameter for allowing the leading end of the spindle shaft 3*ca* of the spindle 3*c* in the winding apparatus 3 to pass therethrough.

Figure 8A:
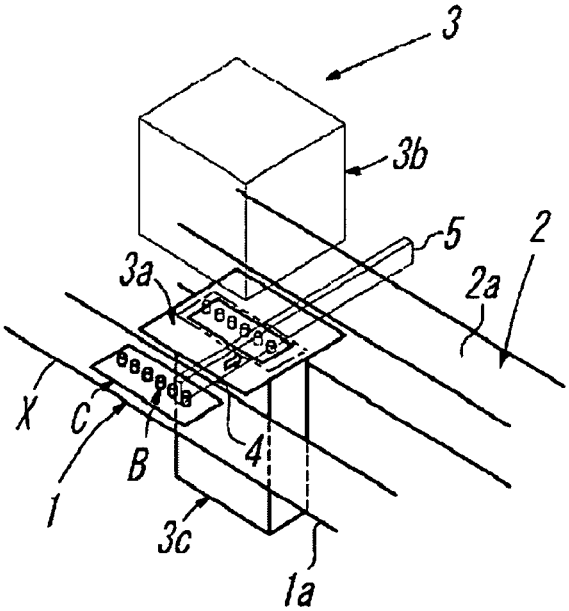
FIGS. 8(A) and 8(B) show the operation of the other principal part of FIG. 5 in sequence of the operation.

According to the embodiment as noted above, the carrier C carrying the bobbins B to be wound with wires is transferred to the winding apparatus 3 by the feed carrying device 1 as shown in FIG. 6. The carrier C carrying the bobbins B is then sent to the working table 3*a* located at the intermediate position between the main frame 3*b* and spindle 3*c*, which are cooperated during winding operation in the winding apparatus 3, by means of the supply/transfer mechanism 4 as shown in FIG. 8(A). Thus, the bobbins B are fed close to the starting point for winding operation in the winding apparatus 3, so that the time and labor spent on advance preparations for winding operation in the winding apparatus 3 can be reduced to effectively carry out the winding operation.

Figure 4A:
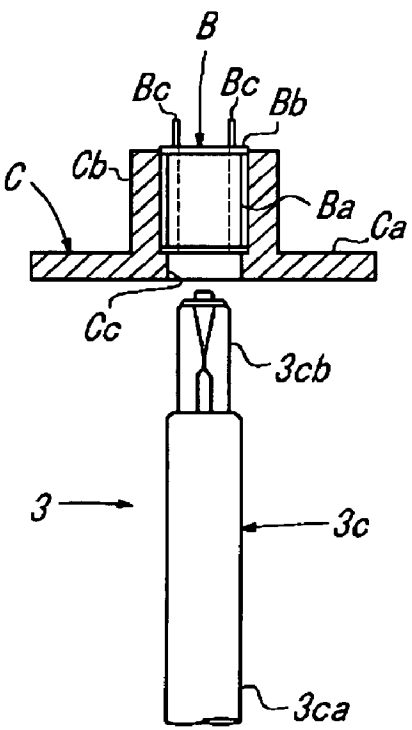
FIGS. 4(A) through 4(D) are cross sections showing the operation of the principal part of FIG. 1 in sequence of the operation.
Figure 4B:
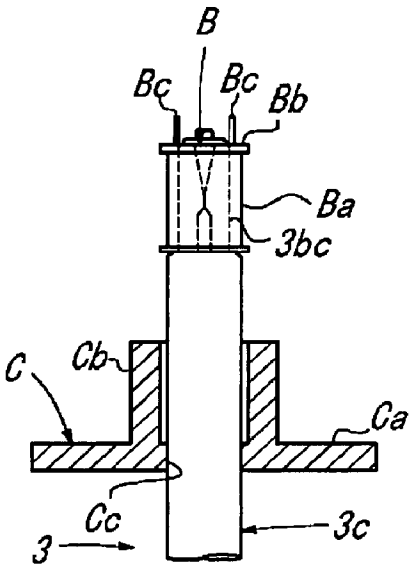

In the winding operation by the winding apparatus 3, the spindle shaft 3*ca* of the spindle 3*c* is moved upward relative to the bobbins B (carrier C) placed on the support face 3*aa* of the working table 3*a* by the driving cylinder 3*cf* as shown in FIG. 1 and FIGS. 4(A) and 4(B). The spindle shaft 3*ca* of the spindle 3*c* moves upward through the window-like support face 3*aa* of the working table 3*a* and the insertion hole Cc formed in the carrier C and is fitted into the hollow bobbin B. At this time, the bobbin retainer 3*d* has a function of preventing the bobbin B from uplifting unnecessarily. Consequently, the bobbin B can be effectively pulled out from the support projection Cb of the carrier C by the spindle shaft 3*ca* of the spindle 3*c* and forwarded toward the nozzle 3*ba* of the main frame 3*b*. In the meantime, the bobbin B is steadily retained by the chuck mechanism 3*cb* of the spindle 3*c*. Thus, the time and labor spent on advance preparations for winding operation in the main frame 3*b* having the relatively complicated structure can be reduced to effectively carry out the winding operation by means of the spindle 3*c* having the simple structure relative to the winding apparatus 3.

Figure 4C:
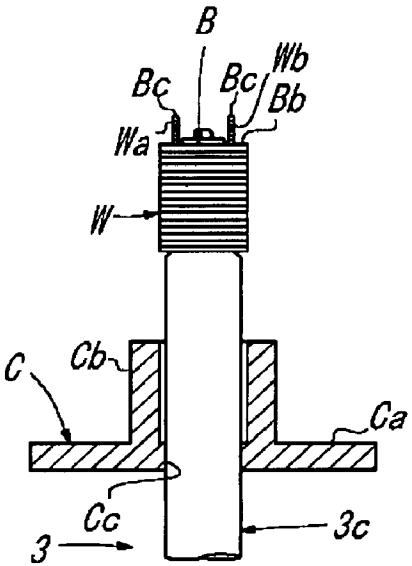

As shown in FIG. 2 and FIG. 4(C), the winding operation in the winding apparatus 3 is carried out by the three-dimensional movement of the three-dimension moving mechanism 3*bb* of the nozzle 3*ba* of the main frame 3*b* and the rotation produced by the spindle motor 3*cc* of the spindle shaft 3*ca* of the spindle 3*c*, thus to wind the wire W around the shank Ba of the bobbin B while twisting the leading end Wa and tail end Wb of the wire around a lead pin Bc protruding from a flange Bb before and after the winding operation. The bobbin B is firmly retained by the chuck mechanism 3*cb* of the spindle shaft 3*ca* of the spindle 3*c* so as not to be dislocated unexpectedly from the prescribed position in the winding operation.

Figure 4D:
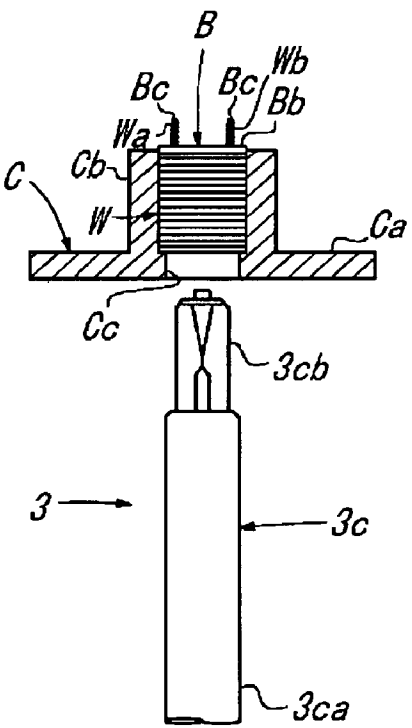

When finishing the winding operation performed by the cooperative movement of the main frame 3*b* and the spindle 3*c* in the winding apparatus 3, the spindle shaft 3*ca* of the spindle 3*c* moves downward by the driving cylinder 3*cf*, to place the bobbin B on the support projection Cb of the carrier C, as shown in FIG. 4(D).

Figure 8B:
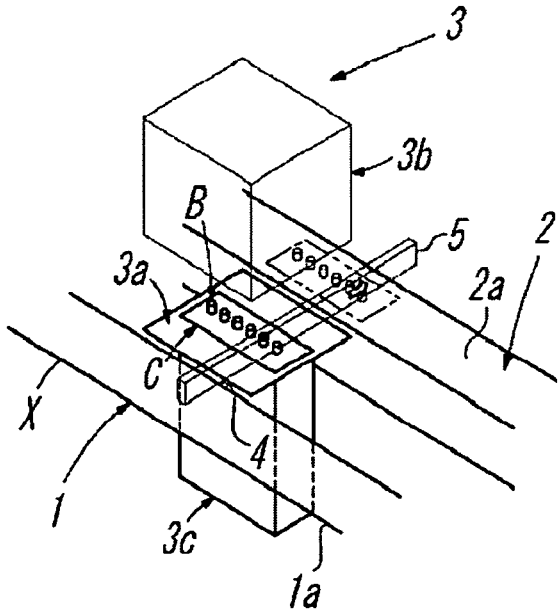

The carrier C carrying the bobbins B wound with the wires is sent to the retrieval carrying device 2 from the support face 3*aa* of the working table 3*c* in the winding apparatus 3 by the retrieval moving device 5 as shown in FIG. 8(B). At this time, the carrier C carrying bobbins B to be newly wound with wires is fed from the feed carrying device 1 to the working table 3 in the winding apparatus, as shown in FIG. 6.

Consequently, device downtime of the winding apparatus 3 caused by feeding and retrieving the bobbins B can be surely shortened, thereby enabling a substantially continuous winding operation in the winding apparatus 3.

Figure 9A:
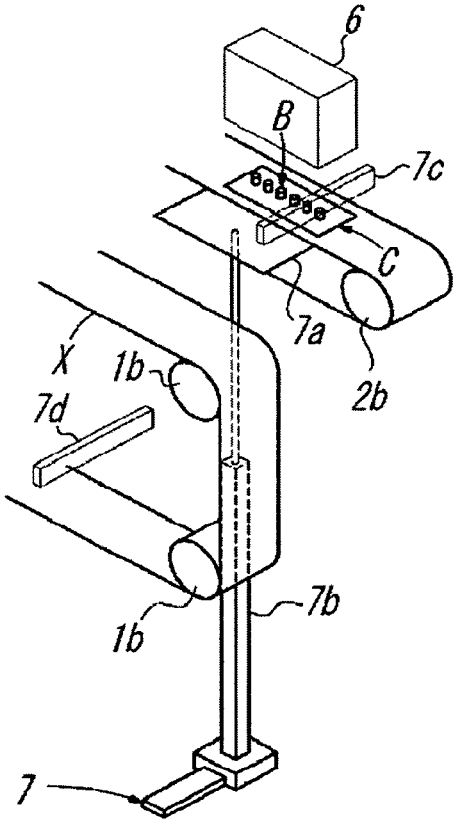
FIGS. 9(A) and 9(B) show the operation of the other principal part of FIG. 1 in sequence of the operation.
Figure 9B:
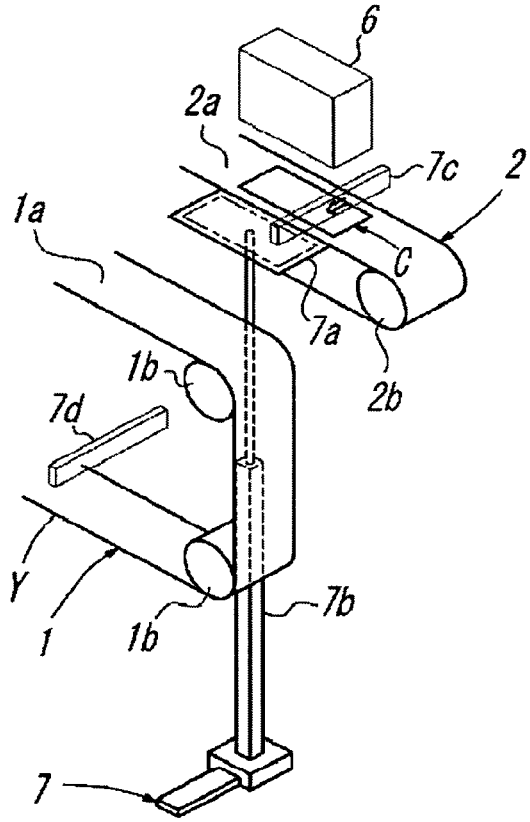
Figure 10A:
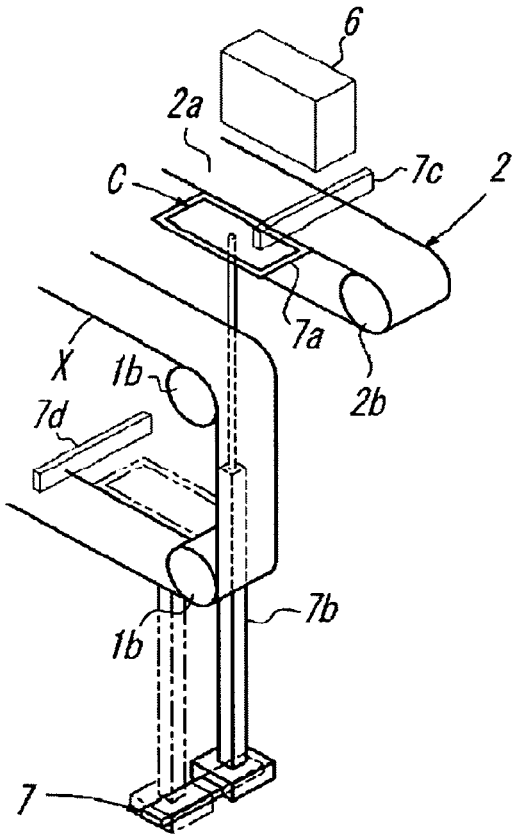
FIGS. 10(A) and 10(B) show the subsequent operation of FIG. 6.
Figure 10B:
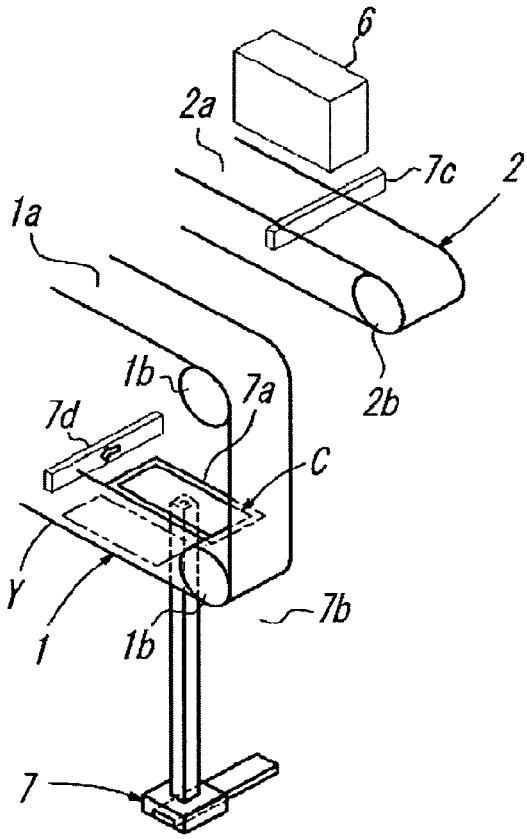

The bobbins B wound with the wires are effectively retrieved from the carrier C by the bobbin retrieving device 6 in the process of being transferred to the retrieval carrying device 2. The empty carrier C is transferred to the return path Y of the feed carrying device 1 by the transferring device 7 as shown in FIG. 9 and FIG. 10, and then transferred to the forward path Y of the feed carrying device 1 by the refeeding mechanism 8, thereby to be again fed to the winding apparatus 3. Before the winding apparatus 3, there is placed a bobbin supply device 9 for supplying the bobbin B onto the empty carrier C.

Figure 11:
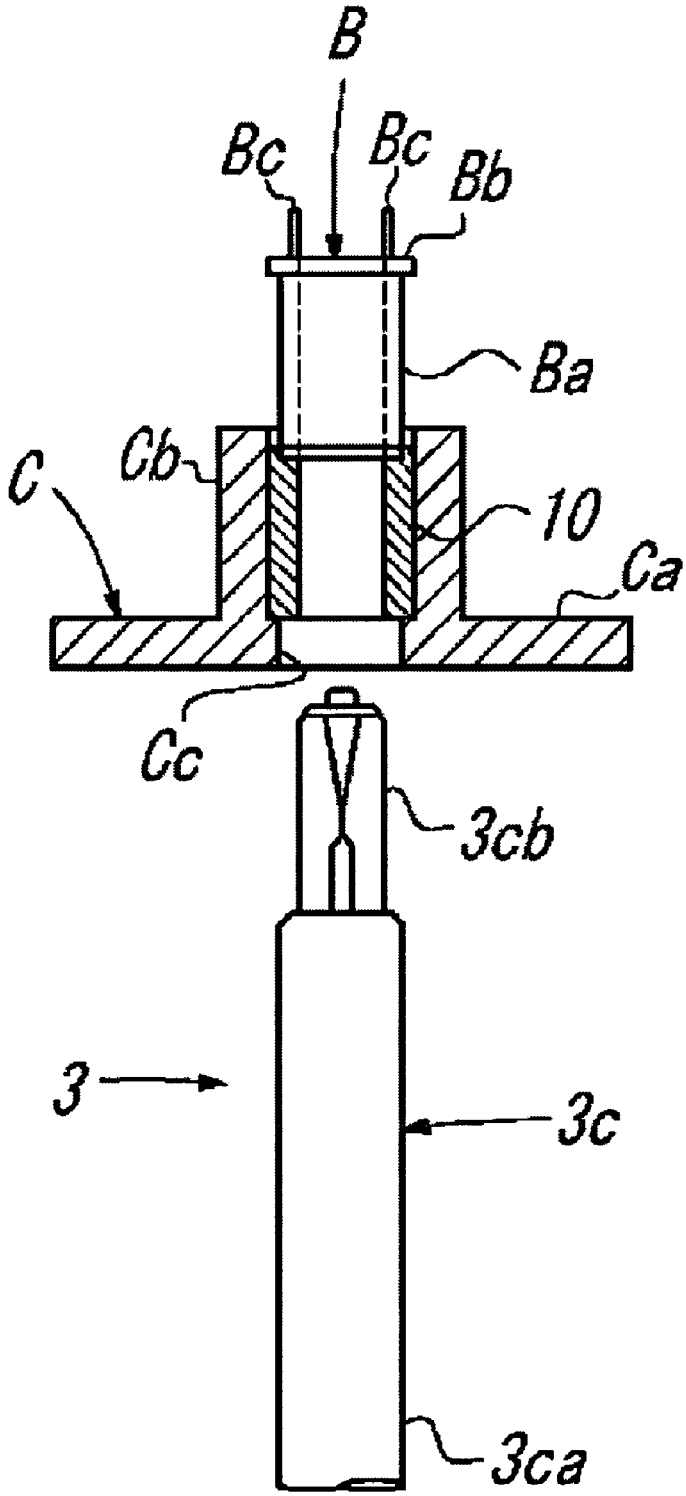
FIG. 11 is a cross section showing the deformed state of the bobbin and carrier.

FIG. 11 shows the carrier C which is connected to a hollow auxiliary jig 10 for receiving the solid bobbin B fitted into the support projection Cb in another embodiment.

The bobbin B illustrated in FIG. 11 is retained by the chuck mechanism 3*cb* of the spindle shaft 3*ca* of the spindle 3*c* fitted into the auxiliary jig 10 in the winding apparatus 3.

In the other embodiment than the foregoing embodiments, a single bobbin B may be mounted on one carrier C.

It is optional to use a soldering device for soldering the leading end Wa and tail end Wb of the wire W twisted around the lead pin Bc of the bobbin B, a taping device for preventing winding crumble of the wire W wound on the shank Ba of the bobbin B, an inspection device for performing a conductivity test of the wire wound on the bobbin B and/or other devices.

INDUSTRIAL APPLICABILITY

This invention can be used for the purpose of effectively performing the operation of winding wire in the wire winding apparatus.

The invention claimed is:

1. A winding apparatus using a carrier carrying a bobbin to be wound with wire, the winding apparatus comprising:

a nozzle for supplying wire to be wound around said bobbin;

a spindle shaft for rotating said bobbin;

a working table opposing said nozzle and said spindle shaft so as to introduce said carrier into a space between said nozzle and said spindle shaft; and a support member for detachably supporting said bobbin, said support member being arranged such that a longitudinal axis of said bobbin is substantially parallel to a direction in which said nozzle and said spindle shaft oppose each other, wherein said carrier is provided with an insertion hole for allowing said spindle shaft to pass therethrough as said spindle shaft moves relative to said bobbin supported by said support member, and wherein said spindle shaft is placed below said working table and is retractable relative to said bobbin carried on said carrier fed onto said working table so as to allow said bobbin to move between said carrier and said nozzle.

2. The winding apparatus set forth in claim 1, wherein said carrier includes said support member, and wherein said support member of said carrier is formed in a cylindrical shape having a prescribed cross section so as to detachably attach said bobbin therein in the axial direction.

3. The winding apparatus set forth in claim 2, wherein said carrier does not include another support member.

4. The winding apparatus set forth in claim 2, wherein said carrier further includes at least one additional support member for detachably supporting at least one additional bobbin.

5. The winding apparatus set forth in claim 2, wherein said bobbin is formed in a hollow shape so as to allow a leading end of said spindle shaft to be fitted therein, and wherein said spindle shaft includes a chuck mechanism for internally holding said bobbin.

6. The winding apparatus set forth in claim 2, wherein said bobbin is formed in a non-hollow shape, and wherein said bobbin has an auxiliary jig so as to be engaged with a leading end of said spindle shaft, and said spindle shaft includes a chuck mechanism for internally holding said auxiliary jig.

7. The winding apparatus set forth in claim 1, wherein said support member is included in said carrier, and wherein said carrier does not include another support member.

8. The winding apparatus set forth in claim 7, wherein said bobbin is formed in a hollow shape so as to allow a leading end of said spindle shaft to be fitted therein, and wherein said spindle shaft includes a chuck mechanism for internally holding said bobbin.

9. The winding apparatus set forth in claim 7, wherein said bobbin is formed in a non-hollow shape, and wherein said bobbin has an auxiliary jig so as to be engaged with a leading end of said spindle shaft, and said spindle shaft includes a chuck mechanism for internally holding said auxiliary jig.

10. The winding apparatus set forth in claim 1, wherein said carrier includes said support member, and said carrier further includes at least one additional support member for detachably supporting at least one additional bobbin.

11. The winding apparatus set forth in claim 10, wherein said bobbin is formed in a hollow shape so as to allow a leading end of said spindle shaft to be fitted therein, and wherein said spindle shaft includes a chuck mechanism for internally holding said bobbin.

12. The winding apparatus set forth in claim 10, wherein said bobbin is formed in a non-hollow shape, and wherein said bobbin has an auxiliary jig so as to be engaged with a leading end of said spindle shaft, and said spindle shaft includes a chuck mechanism for internally holding said auxiliary jig.

13. The winding apparatus set forth in claim 1, wherein said bobbin is formed in a hollow shape so as to allow a leading end of said spindle shaft to be fitted therein, and wherein said spindle shaft includes a chuck mechanism for internally holding said bobbin.

14. The winding apparatus set forth in claim 1, wherein said bobbin is formed in a non-hollow shape, and wherein said bobbin has an auxiliary jig so as to be engaged with a leading end of said spindle shaft, and said spindle shaft includes a chuck mechanism for internally holding said auxiliary jig.

15. The winding apparatus set forth in claim 1, wherein said carrier includes said support member, and further includes at least one additional support member for detachably supporting at least one additional bobbin, and wherein said carrier is provided with an insertion hole extending through each support member for allowing said spindle shaft to pass therethrough as said spindle shaft moves relative to said carrier.

16. A winding apparatus using a carrier for carrying a bobbin to be wound with wire, the winding apparatus comprising:

a nozzle for supplying wire to be wound around the bobbin;

a spindle shaft for rotating the bobbin;

a working table opposing said nozzle and said spindle shaft so as to introduce said carrier into a space between said nozzle and said spindle shaft; and a support member for detachably supporting the bobbin, said support member being arranged such that a longitudinal axis of the bobbin is substantially parallel to a direction in which said nozzle and said spindle shaft oppose each other, wherein said carrier is provided with an insertion hole for allowing said spindle shaft to pass therethrough as said spindle shaft moves relative to the bobbin supported by said support member, and wherein said spindle shaft is movable to a position below said working table and is retractable and extendable relative to said carrier fed onto said working table so as to move the bobbin between said carrier and said nozzle.

17. The winding apparatus set forth in claim 16, wherein said carrier includes said support member, and wherein said support member of said carrier is formed in a cylindrical shape having a prescribed cross section so as to detachably attach the bobbin therein in the axial direction.

18. The winding apparatus set forth in claim 16, wherein said support member is included in said carrier, and wherein said carrier does not include another support member.

19. The winding apparatus set forth in claim 16, wherein said carrier includes said support member, and further includes at least one additional support member for detachably supporting at least one additional bobbin.

20. The winding apparatus set forth in claim 16, wherein said carrier includes said support member, and further includes at least one additional support member for detachably supporting at least one additional bobbin, and wherein said carrier is provided with an insertion hole extending through each support member for allowing said spindle shaft to pass therethrough as said spindle shaft moves relative to said carrier.

* * * * *